US006066235A

United States Patent [19]

Scheinberg

[11] Patent Number: 6,066,235

[45] Date of Patent: May 23, 2000

[54] WETLAY PROCESS FOR MANUFACTURE OF HIGHLY-ORIENTED FIBROUS MATS

[75] Inventor: Stephen P. Scheinberg, Wilmington, Del.

[73] Assignee: E. I. du Pont de Nemours and Company, Wilmington, Del.

[21] Appl. No.: 09/054,771

[22] Filed: Apr. 3, 1998

[51] Int. Cl.[7] ..... D21F 1/00

[52] U.S. Cl. ..... 162/141; 162/131; 162/156; 162/157.1; 162/202; 162/211; 162/212; 162/216; 162/145; 162/146; 162/152; 162/157.2; 162/158; 162/164.1; 162/164.6; 162/168.1; 162/169

[58] Field of Search ..... 162/131, 157.1, 162/156, 202, 211, 212, 216, 384, 100, 141, 145, 146, 152, 157.2, 158, 164.1, 164.6, 168.1, 169; 442/327, 332, 333

[56] References Cited

U.S. PATENT DOCUMENTS

| | | | |
|---|---|---|---|
| 4,049,491 | 9/1977 | Brandon | 162/101 |
| 4,925,528 | 5/1990 | Tse et al. | 162/146 |
| 5,009,747 | 4/1991 | Viazmensky et al. | 162/115 |
| 5,164,255 | 11/1992 | Weeks . | |
| 5,182,060 | 1/1993 | Berecz . | |
| 5,194,106 | 3/1993 | Geary, Jr. . | |
| 5,409,573 | 4/1995 | Weeks . | |

FOREIGN PATENT DOCUMENTS

| | | |
|---|---|---|
| 7-88840 | 4/1995 | Japan . |
| 8-72154 | 3/1996 | Japan . |
| 8-232187 | 9/1996 | Japan . |
| 8-269209 | 10/1996 | Japan . |
| 9-41280 | 2/1997 | Japan . |
| 9-41281 | 2/1997 | Japan . |
| 9-52289 | 2/1997 | Japan . |
| 1128321 | 6/1968 | United Kingdom . |
| 1249291 | 10/1971 | United Kingdom . |
| 1389539 | 4/1975 | United Kingdom . |

OTHER PUBLICATIONS

Casey, James P "Pulp and Paper" vol. 2 Wiley–Interscience, p1129–1153, Oct. 31, 1980.

*Primary Examiner*—Peter Chin
*Assistant Examiner*—Robert McBride

[57] ABSTRACT

A mat containing highly machine direction oriented (90% or greater), discontinuous reinforcement fibers, is produced on inclined wire or rotary paper making machinery. Fibers are first uniformly dispersed in an aqueous medium containing thickeners and wetting agents. In one embodiment, anti-foaming agents are also added to prevent floating fibers which entangle and reduce orientation. Thermoplastic fibers or particles may also be included. Stock is brought into an open headbox in a flow pattern which allows the fibers to decelerate before approaching the porous suction belt (wire). As the fibers approach the suction belt, the fibers begin to turn and align in the streamline so as to present one end toward the suction wire. The leading ends of the fibers are gripped by the moving belt which drags the fibers out of the dispersion stock in a straight line. The porous mat produced may be dried and bonded through hot air, heat and/or pressure, or chemical binders. Stacks of such mats may be compressed partially to produce porous structures, or fully to produce

23 Claims, 4 Drawing Sheets

WETLAY PROCESS FOR MANUFACTURE OF HIGHLY-ORIENTED FIBROUS MATS

GOVERNMENT INTEREST

The invention described herein was made in the course of work under a grant or award from National Institute of Standards and Technology (NIST).

BACKGROUND OF THE INVENTION

1. Field of the Invention

The present invention is directed generally to processes for forming layers of fibrous material and, more specifically, to a wetlay process for manufacturing highly-oriented fibrous mats.

2. Description of the Related Art

Wetlay processes for manufacturing fibrous mats have typically been directed to the use of long glass, mineral wool or carbon fibers on both inclined wire wetlay machines and on rotary formers (cylinder machines). Typical wetlay processes involve injecting stock containing a plurality of fibers into the headbox of a wetlay machine. Suction under a wirebelt draws fibers within the stock toward the wirebelt to ultimately form a fibrous mat. In general, fiber orientation is often controlled to make it as random (square or 1:1 strength profile) as possible. Various existing patents depict machinery improvements to prevent shear boundary layers which might tend to form small areas of oriented fiber. For example, such shear boundary layers often form at the side walls of the headbox or between adjacent stock flows into the headbox. This is because inadvertent fiber alignment in the machine direction reduces transverse (cross machine) mat strength.

Typical glass mat machines may produce a maximum of 1.4 to 1 machine direction (MD) to cross-machine direction (CD) orientation (58% MD orientation), because the suction (forming) wire speed is higher than the incoming water speed. A few machines have been known to orient at a 4 to 1 ratio (80%), while even fewer machines have been known to orient at a 6 to 1 ratio (6/7=85.7%).

In general, degree of orientation is measured as:

$$[MD/CD]/[(MD/CD)+1]$$

where the span between the jaws of the tensile tester is longer than the longest reinforcement fiber in the structure to avoid bridging the gap.

All prior attempts, however, have failed to produce a greater than 90% wetlay orientation (9 to 1 MD to CD strength ratio or greater). As such, there exists a need to develop fibrous mats having the strength characteristics associated with a mat having greater than 90% wetlay orientation. In addition, many prior attempts to improve existing machinery required the use of nozzles to increase fiber velocity. Such prior attempts have not, however, readily lent themselves to retrofitting existing machinery. As such, there is currently a need to develop a cost-effective and efficient system to retrofit existing machinery so that they are capable of providing mats with at least a 90% wetlay orientation.

SUMMARY OF THE INVENTION

In accordance with the present invention, the invention includes a method of producing highly-oriented fibrous mats having at least a 90% machine direction orientation including the steps of producing a thickened solution containing a plurality of suspended fibers, introducing the thickened suspension into a headbox of a wetlay machine and decelerating the fiber suspension to a velocity less than wirebelt operating velocity, and applying suction through the wirebelt to orient and pin the fibers on the wirebelt.

The present invention also includes a method of retrofitting an existing headbox of a wetlay machine so as to produce highly-oriented fibrous mats, including the steps of increasing head level within the headbox to increase headbox stock capacity, and accelerating operating velocity of a wirebelt within the wetlay machine beyond an operating velocity of stock entering the headbox.

The present invention also includes end products made of a plurality of mats, each of the mats including a plurality of discontinuous reinforcement fibers having at least a 90% machine direction orientation.

DETAILED DESCRIPTION OF THE PRESENT INVENTION

Figure 1:
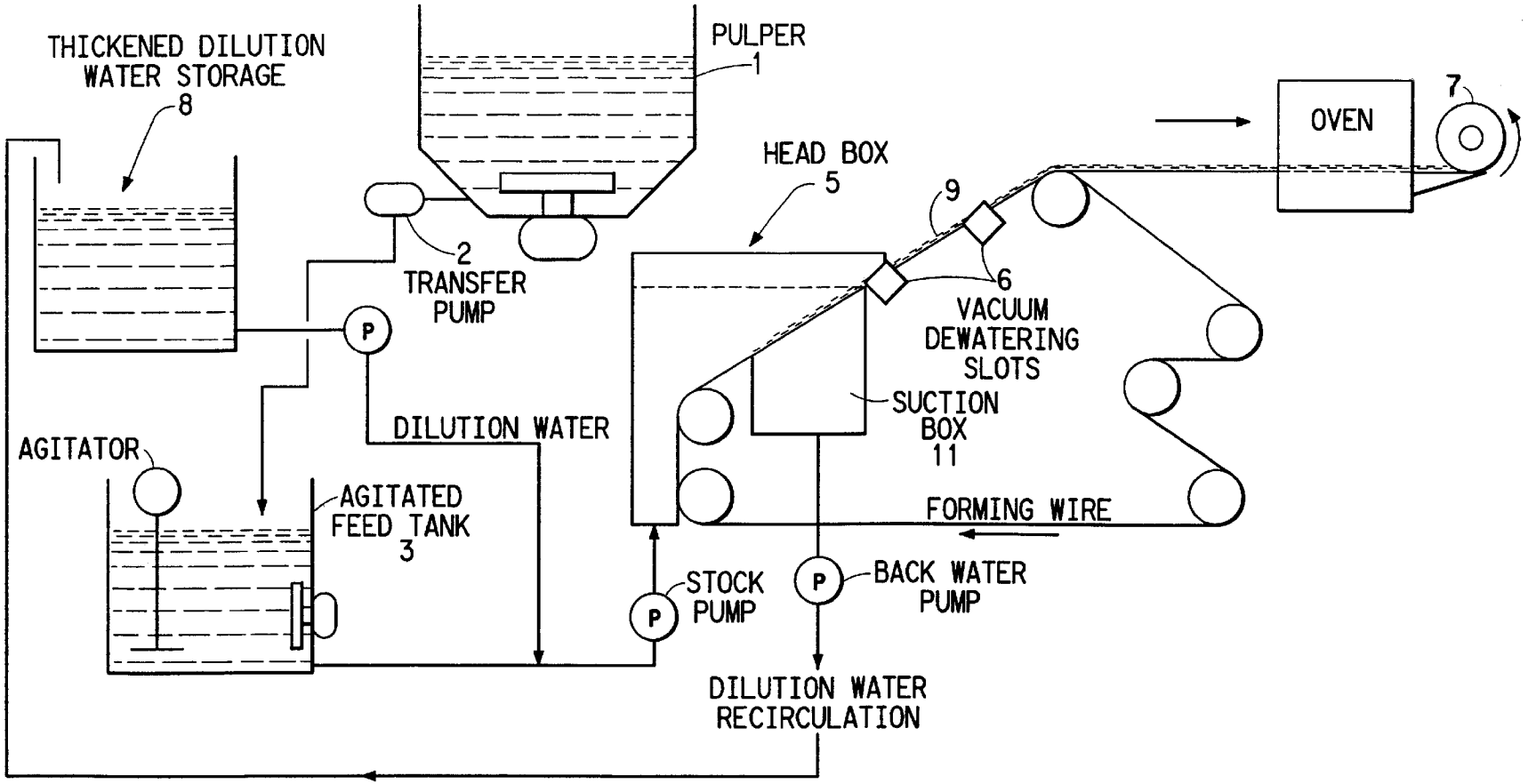
FIG. 1 is a schematic illustration of a wet-laying process used in the present invention.

With reference to FIG. 1, a wet laying process used in an embodiment of the present invention is shown. The process utilizes paper making equipment which may include a pulper 1, a transfer pump 2, an agitated supply tank 3, the headbox 4 of an inclined wire paper machine 5, a suction box 11, a dewatering section 6, and a windup or driven spool 7. In operation, reinforcement fibers and thermoplastic fibers are dispersed in water in pulper 1. The slurry is transferred via a pump 2 from the pulper to an agitated supply tank 3. Feed stock from the supply tank is then pumped to the headbox 4. Dilution water is added from tank 8 to the feed line before the headbox 4 to reduce stock consistency. The slurry is drained through the wire by suction box 11 and forms a mat 9 which is dewatered by passing over suction slots 6 in the dewatering section. The dewatered sheet is then wound in damp form on driven spool 7. The sheet 9 wound on the spool 7 is unwound in layers and dried. Alternatively, the dewatered sheet is passed through a convection oven, dried and/or fused, and wound-up.

Figure 2:
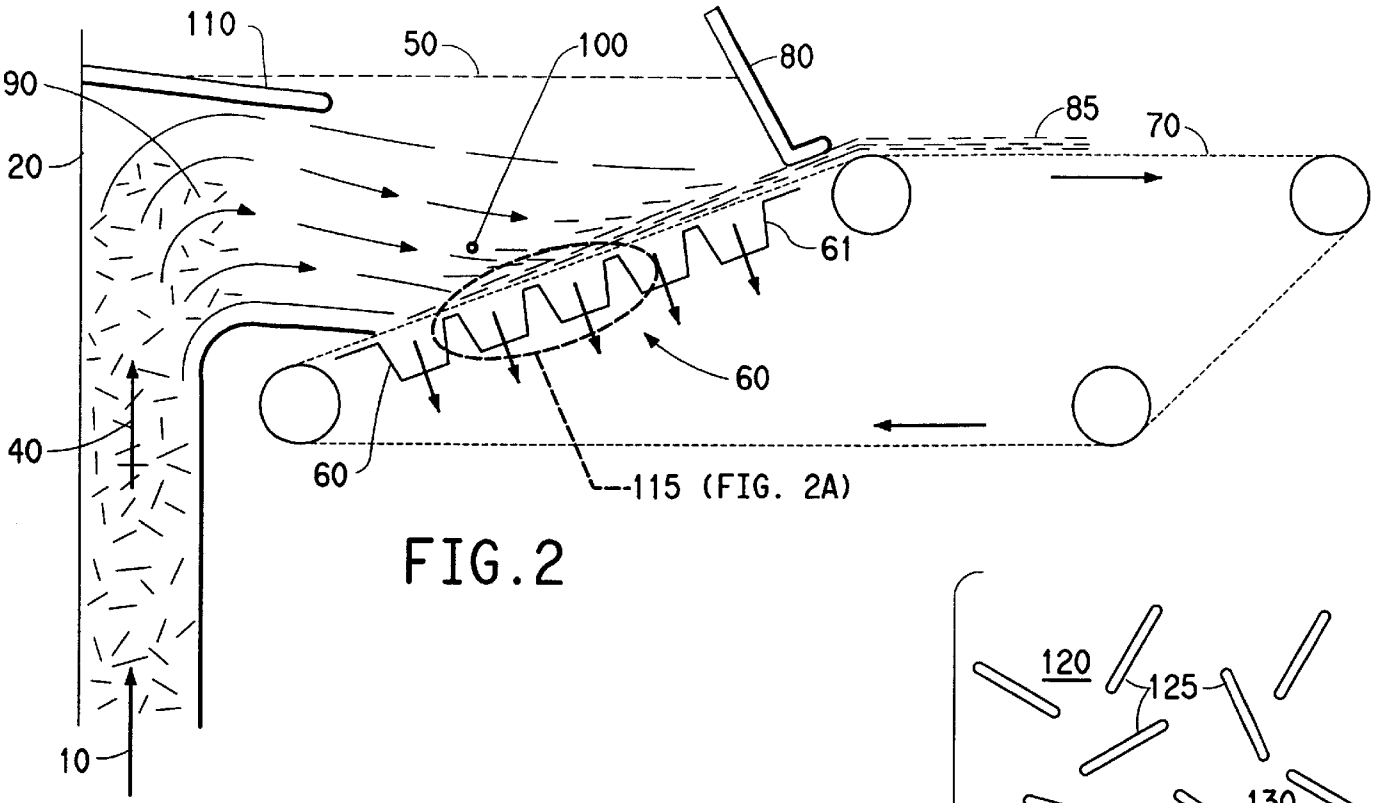
FIG. 2 is a view of an inclined wire wetlay machine incorporating features of the present invention.
Figure 3:
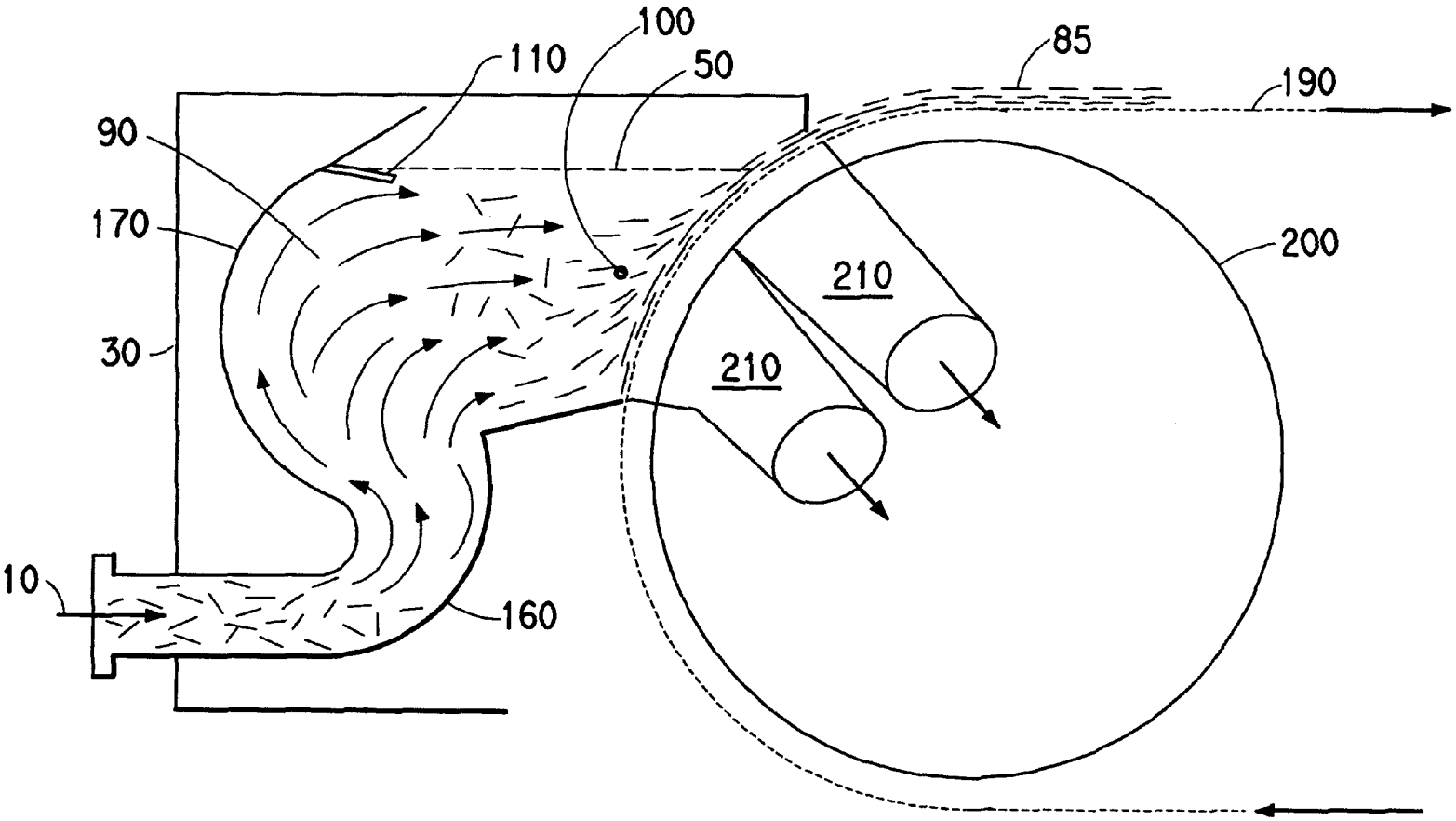
FIG. 3 is a view of a rotary cylinder wetlay machine incorporating features of the present invention.
Figure 3A:
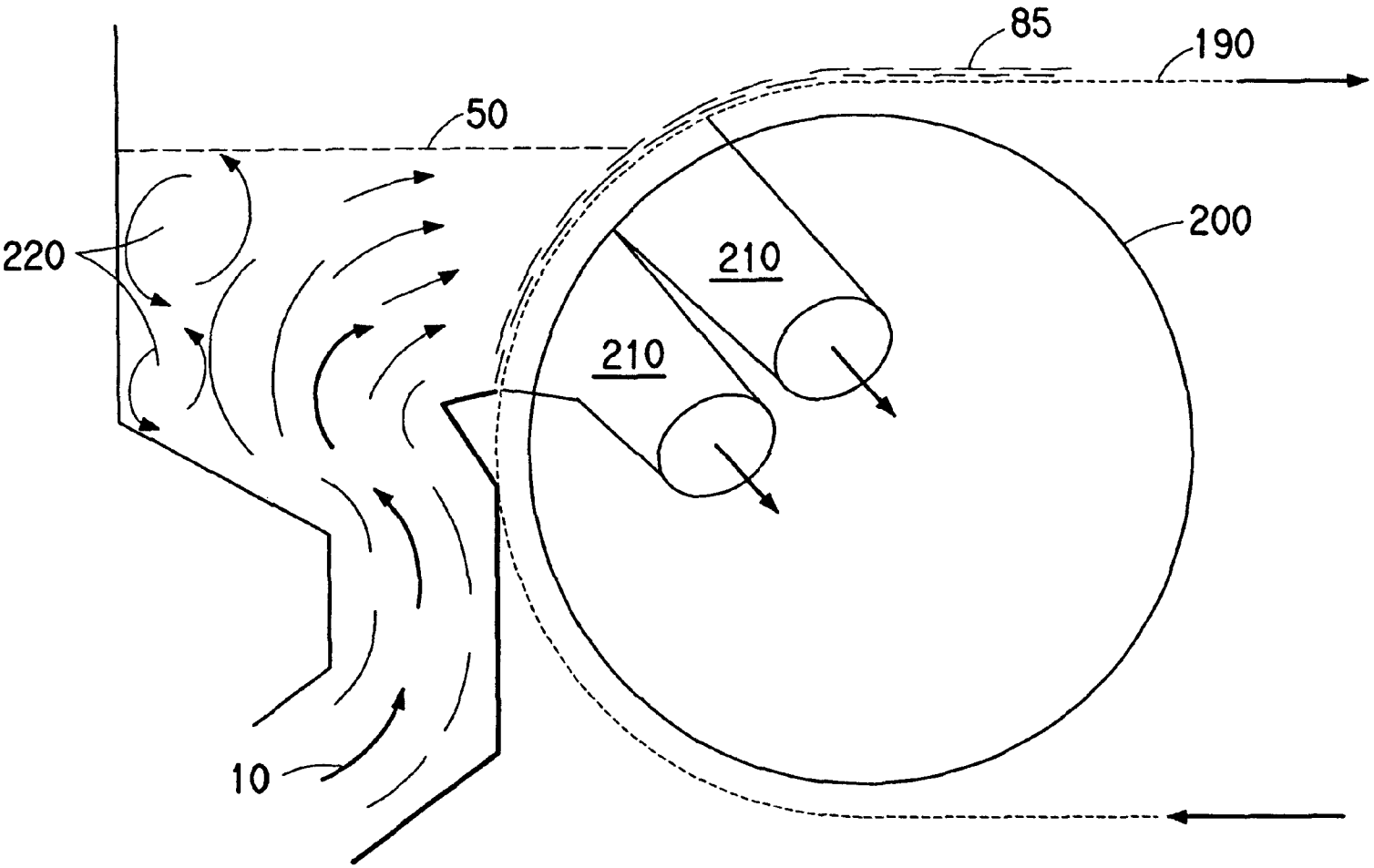
FIG. 3A is a view of a standard rotary cylinder which suffers from "dead" spots containing eddy current formations.

With reference to FIGS. 2–3A, two embodiments of the present invention will now be shown and described in greater detail. In general, fibers in the present invention are aligned as they move toward a belt in a large open body of thickened fluid. The moving belt operates at a higher speed than the approaching water and fibers. A nozzle for preorienting the fibers by increasing fiber and fluid velocity is not needed.

With reference to the Figures, discontinuous reinforcement fibers are 20 uniformly and individually dispersed in a thickened water containing a thickener and a wetting agent which are selected for compatibility with the solids to be dispersed and the chemistry of surface finishes supplied on the solids. Optionally, discontinuous thermoplastic fibers or particles may also be added to the thickened water. The discontinuous reinforcement fibers are typically ¾" to 1.25" long (1.9 to 3.2 cm). However, these discontinuous reinforcement fibers may be as long as 2.5" (6.4 cm) or as short as 0.039 inches (1 mm). Viscosity is typically set at 1.5 centipoise or greater, although it is to be understood that the viscosity may be set at other values. When shear thinning (thixotropic) thickening systems are used, viscosity is typically set at 8 centipoise or greater.

In one embodiment of the present invention, the reinforcement fibers are all one length, diameter, and material. In the alternative, the reinforcement fibers may have a distribution of lengths and/or diameters. The reinforcement fibers may also consist of a mixture of materials, stiffnesses, and percentage compositions. The reinforcement fibers may include but are not limited to: PAN (polyacrylonitrile) or Pitch based carbon (graphite), glass, para-aramid, ceramics, metals, high temperature thermoplastics, thermosets, liquid crystal polymer fibers, ultra high molecular weight polyethylene, natural fibers, natural or synthetic spiderweb. The reinforcement fibers may also have surface treatments or finishes designed to promote adhesion to a thermoplastic component. The reinforcement fiber may have a surface which is oxidized to promote water dispersion and adhesion. Surface oxidation of carbon fibers may be provided, for example, by ozone treatment. The surface modification of reinforcement fibers may also be provided by plasma treatment in selected species. It is to be noted that the preferred concentration of the reinforcement fiber component to the thermoplastic component is 60–70 weight % reinforcement fiber and 40–30 weight % thermoplastic component. Although either or both drawn and undrawn thermoplastic fibers may be used, undrawn fibers are preferred as drawn fibers may cause wrinkling/misalignment within the mat.

In other embodiments of the present invention, the thermoplastic component may be a fiber, granular particle or flat platelet, although the preferred form of thermoplastic component is fiber. The preferred fiber length falls in the range of 0.6 to 1.3 cm. (0.25 inch to 0.5 inch.) In other embodiments, the thermoplastic component is fibers of a single material and length, and/or one of mixed materials, forms, melting points, sizes(lengths & diameters), molecular weights, and/or mixture composition (%). The thermoplastic components may include, but are not limited to, polyethylene, polypropylene, polyethylene terephthalate (PET), polyamides, polyethylene naphthalate (PEN), polyetheretherketone (PEEK) and polyetherketoneketone (PEKK). The thermoplastic component may be cross-linkable in a later process step. The thermoplastic component may contain additives, including, but not limited to: fillers, antioxidants, color, electrically or thermally conductive or insulating materials, adhesion aids, melt flow modifiers, cross-linking agents, and chemically or biologically reactive materials, and molecular sieves.

In one embodiment of the present invention, an antifoaming agent is added to the thickened water to prevent entrainment of fibers which entangle in the floating foam, and reduce orientation.

Typically, prior to introduction to the headbox, stock is dispersed with a 0.5 to 2 weight % solids content and diluted to 0.05% to 0.2% with thickened water of the same composition. In the alternative, the final dilution concentration may be mixed and pumped directly to the headbox. While dissimilar fibers may added in any order, including simultaneously, it is preferred that thermoplastic fibers be dispersed before the reinforcement fibers to aid dispersion and reduce mixing time which may cause breakage damage to high modulus fibers. Alternatively, reinforcement fibers and thermoplastic fibers may be dispersed separately and then combined in a stock tank or in line to the headbox.

With reference to FIGS. 2 and 3, dispersed stock 10 is uniformly introduced across the width of an open headbox 20 of an inclined wire wetlay machine or an open headbox 30 of a rotary cylinder wetlay machine. Because the headbox is open, the surface of the water is open to atmospheric pressure. Stock flow in the headbox is designed to a) minimize turbulence and fiber entanglement, b) slow or stall fiber velocity, c) maintain individual fiber separation, and d) promote laminar flow of fibers toward the suction wire so that (1) out of plane (through direction) fiber deposition is minimized, (2) a thin flat mat is formed, and (3) translation of machine direction modulus (in subsequent applications such as consolidated structural sections) is increased.

In the inclined wire wetlay machine of FIG. 2, stock entering the headbox flows substantially vertically, as shown at reference numeral 40, against a liquid head 50 which is maintained at a height greater than the highest vertical position of the last suction box 61 of a plurality of suction boxes 60 under the moving forming wire 70 by a regulator weir 80, the bottom edge of which is spaced sufficiently higher than the wire surface so as to not to interfere with the mat 85 as it exits, or to influence fiber orientation. The forming "wire" 70 is a porous moving belt typically made of woven metal wire or synthetic filaments. Preferably, the belt has a square or rectangular weave pattern. The belt may also be a woven, nonwoven, multilayer or knit fabric, or have a carrier fabric lying on the moving wire belt. Although the present invention may be used with a twill weave belt and successfully achieve a greater than 90% oriented mat, the twill weave belt will collect fibers in angled grooves between the wires, thereby reducing machine direction orientation.

With continuing reference to FIGS. 2 and 3, the stock stream must turn 60 to 180 degrees at reference point 90 in order to approach the forming wire. Fiber velocity is slowed substantially, turbulence is greatly reduced, and flow in the body of the stock stream approaching the suction wire becomes substantially laminar at reference point 100. A separate plate or extension 110 to the rear upper portion of the headbox may be added to deflect fibers under the surface to prevent floating and entanglement.

With reference to FIG. 2, the linear velocity of the porous collecting surface 70 is set equal to or greater than 3 times the linear velocity of the stock in the body at point 90 in the body of the headbox (typically 4–8 times or more). Preferably, however, the ratio of linear wire velocity to velocity of water in the body of the headbox is between 4:1 and 10:1. Gravity or vacuum assisted suction boxes 60 aligned across the underside of the forming wire and spaced along its path, accelerate the aqueous dispersion locally, pull the liquid through the moving wire screen, and pin the fibers to the wire.

Figure 2A:
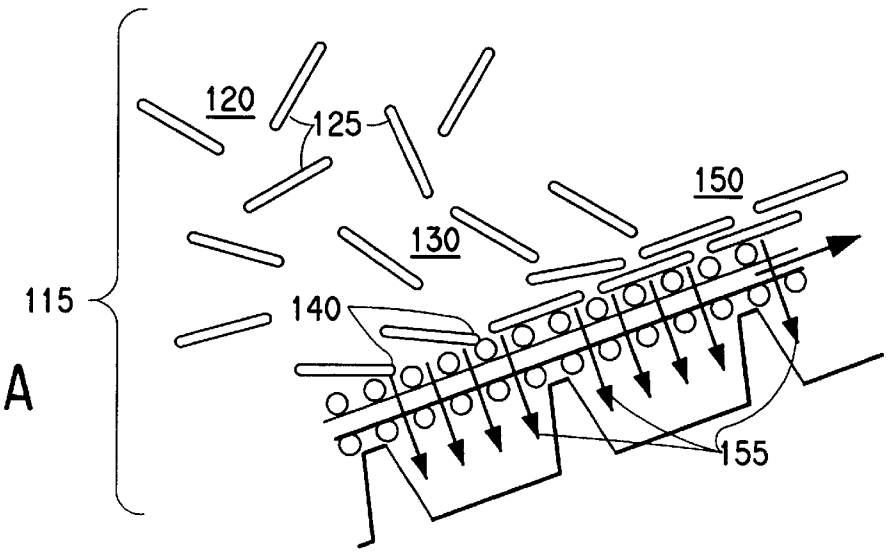
FIG. 2A is a blown-up portion of FIG. 2.

With reference to FIG. 2A, a blown-up portion 115 of the suction boxes is shown. As the randomly oriented fiber dispersion 120 approaches the wire surface, the locally increased liquid velocity begins to rotate the fibers 125 so they partially orient at point 130 in the direction of the local flow streamline. The leading ends of the fibers 140 are pinned to the wire by suction. The higher velocity wire drags the fibers into alignment 150 as the rest of their lengths are pinned to the belt. Successive oriented layers of fiber are deposited as the wire moves across the suction boxes. Suction may be increased by vacuum assist to control fiber pinning along the length of the forming section. This is useful for maintaining orientation in the upper layers of heavier weight mat.

In one embodiment of the present invention, the stock enters the inclined wire headbox uniformly across its width, and substantially vertically upward against the liquid head thus slowing the fibers, and must turn essentially right angles proportionately to present the fibers to the wire with reduced turbulence (in a more laminar flow), and with reduced linear velocity. The open head of stock in the inclined wire machine may be set higher, typically 18 to 26 cm (7–10 inches) than the exit point of the last suction box 61 in the formation section. In another embodiment, stock entering the headbox is guided in a substantially backward and upward direction from the direction of belt motion, and must slow against the head, reverse direction in a smooth flow pattern, and present the fibers to the wire with reduced velocity and turbulence.

In the rotary cylinder wetlay machine of FIG. 3, the headbox entry 160 directs the incoming stock upward and to the rear of the headbox (opposite to the exit direction). In the preferred embodiment, the rear of the headbox is streamlined to the natural hydraulic curvature 170 of the stock flow as it reverses direction and moves in a laminar flow 100 toward the forming wire 190 which is supported on a rotating cylindrical drum 200 and is moving at 3 times or greater the linear velocity of the stock at point 90 in the headbox. Suction boxes 210 under the wire cause the reinforcement fibers to deposit with greater than 90% machine direction orientation by the same mechanism as described for the inclined wire machine.

With reference to FIG. 3A, the streamlined rear headbox design of FIG. 3 eliminates "dead" spots 220 in which eddy current formation causes fiber entanglement and reduces orientation. In one embodiment of the present invention, such a streamlined headbox conforms to the natural streamline flow of the stock.

It is also to be understood that a rotary former is a form of infinitely varying inclined wire machine.

With reference to FIGS. 2 and 3, the mat 85 formed has greater than 90% orientation and in the preferred form, greater than 95% machine direction orientation of reinforcement fiber. It is suitable for manufacture of strong, stiff composites with engineered properties. When it contains a thermoplastic component, it can be melted and stabilized in an incline convection oven. When the mat contains a thermoplastic component, it is preferentially dried and bonded in a through-air convection oven, and wound on rolls. The mat may also be sprayed or saturated with chemical binder or size and dried in a continuous oven. The mat may also be dried and wound in rolls without binder. An interleaf layer may also be used. The typical areal or basis weight range is 68 to 339 gm./square meter (2 to 10 oz./square yard), (42 to 208 pounds per 3000 square foot ream), (0.014 to 0.069 pounds/square foot).

Test Results

I. In a first series of tests, a 12 inch (30.5 cm) wide, open headbox inclined wire forming machine configured as in FIG. 1 was used to produce 400 foot (12.2 meter) rolls of oriented mats of Glass/PET, Pan Carbon/PET, and Pitch Carbon/PET on a rectangular weave smooth top surface synthetic wire belt. All process water was thickened to 1.8 centipoise with polyacrylamide viscosity modifier at 0.5% concentration in the water. Surface active agent, and antifoam were added, and pH was adjusted to 8.0–8.2 with ammonia. The initial mix was, in each case, 0.5% total fiber by weight, and the diluted stock entered the headbox at 0.17% solids.

A regulator plate was used as a dam to increase hydrostatic head to 7–9 inches (18 to 23 cm) above the height of the trailing edge of the last suction box. Total head above the leading edge of the first suction box on the inlet end of the machine was maintained at 17–19 inches (43 to 48 cm). The bottom of the regulator was spaced 0.5 inches (1.3 cm) above the wire, and did not contribute to fiber orientation.

For this series of tests, the mat was dried and heated without pressure in a muffler oven at 325 degrees Centigrade to melt the thermoplastic PET fibers. MD and CD tensile strength was measured on 3 inch (7.6 cm) wide samples with a 3 inch (7.6 cm) span.

Operating variables and resultant mat orientation ratios are:

| Identification: | A | B | C | D |
|---|---|---|---|---|
| Reinforcing Fiber | Glass | Glass | Glass | Pan Carbon |
| Reinf. Fiber Modulus Million PSI (gigapascals GPa) | 10.5 (72.4) | 10.5 (72.4) | 33 (228) | 82 (565) |
| Wt % Reinf. Fiber | 60 | 70 | 60 | 60 |
| Vol. % Reinf. Fiber | 44 | 52 | 54 | 49 |
| Length, inches (cm) | | | | |
| Reinf. Fiber | 1 (2.5) | 1.25 (3.2) | 1.0 (2.5) | 1.25 (3.2) |
| PET fiber | 0.5 (1.3) | 0.5 (1.3) | 0.5 (1.3) | 0.5 (1.3) |
| Velocity feet/minute (meters/minute) | | | | |
| Stock | 25 (7.6) | 25 (7.6) | 25 (7.6) | 25 (7.6) |
| Forming Wire | 100 (30.5) | 200 (61) | 100 (30.5) | 100 (30.5) |
| Mat Areal Basis Weight | | | | |
| oz/square yard (gm/m$^2$) | 5.1 (173) | 2.2 (75) | 4.6 (156) | 3.5 (119) |
| lb/3000 sq. ft. ream | 106 | 46 | 96 | 73 |
| MD/CD Tensile Ratio | 27.6 | 73.i | 19.7 | 17.7 |
| MD Orientation of fibers, % | 96.5 | 98.7 | 95.2 | 94.7 |

II. In one particular series of tests, multiple layers of the mat of example IB were stacked and molded under heat and pressure. The theoretical predicted 5 composite modulus was calculated at 4.7 million psi (32.4 gigapascals). Measured modulus was 4.4 million psi. (30.3 gigapascals) which translates to 94% of theoretical.

III. In another series of tests, an 8 inch (20 cm) wide open headbox rotary cylinder wet forming machine was configured as in FIG. 2A. The water chemistry system of Example 1 was used, with a viscosity of 3.5 centipoise. Wire velocity was 100 feet (30.5 meter) per minute, a 4/1 ratio to the 25 feet/minute (7.6 meter/minute) headbox stock velocity. Highly oriented products were made from the following materials:

Glass reinforcement fiber/PET, PAN Carbon/PET, and a hybrid reinforcement mixture of long (1.25 inch or 3.18 cm) Glass with short 0.039 inches (1 mm) Pitch Carbon Fibers. PET thermoplastic fibers were used.

| Operating variables and resultant mat orientation ratios were as follows: | | | | | |
|---|---|---|---|---|---|
| Identification: | A | B | C | D | E |
| Reinforcing Fiber | Glass | Glass | Glass | PAN Carbon | 1) 47 wt. % Glass 2) 23 wt % Pitch Carbon |
| Reinf. Fiber Modulus Million PSI (gigapascals) | 10.5 (72.4) | 10.5 (72.4) | 10.5 (72.4) | 33 (22.8) | 1) 10.5 (72.4) 2) 82 (565) |
| Wt % Reinf. Fiber | 60 | 60 | 60 | 65 | 70 total |
| Vol. % Reinf. Fiber | 44 | 44 | 44 | 55 | 1) 36 2) 21 |
| Length, inches (cm) | | | | | |
| Reinf. Fiber | 1 (2.5) | 1 (2.5) | 1 (2.5) | 1.25 (3.18) | 1) 1.0 (2.5) |
| PET Thermo-plastic fiber | 0.5 (1.3) | 0.5 (1.3) | 0.5 (1.3) | 0.5 (1.3) | 0.5 (1.3) |
| Velocity feet/minute (meters/minute) | | | | | |
| Headbox Stock | 25 (7.6) | 25 (7.6) | 25 (7.6) | 25 (7.6) | 25 (7.6) |
| Forming Wire | 100 (30.5) | 100 (30.5) | 100 (30.5) | 200 (61) | 100 (30.5) |
| Mat Areal Basis Weight | | | | | |
| oz/square yard (gm/m$^2$) | 10.0 (339) | 7.9 (268) | 4.6 (156) | 2.3 (78) | 2.9 (98) |
| lb/3000 sq. ft. ream | 208 | 165 | 96 | 49 | 60 |
| MD/CD Tensile Ratio | 12.5 | 16.2 | 23.2 | 15.6 | 51.6 |
| MD Orientation of fibers, % | 92.6 | 94.2 | 95.9 | 93.9 | 98.1 |

IV. In another series of tests, continuous fabrication of both flat and hat shaped beams was accomplished on the equipment disclosed in U.S. Pat. No. 5,182,060, assigned to E.I. DuPont de Nemours and Co., herein incorporated by reference. These were laminated from stacks of mat with different compositions to demonstrate the concept of engineered hybrids. Flat beams were demonstrated up to 6 feet long (1.83 meters) and 4 inches (10 cm) wide. Thickness measurements showed a final consolidation of 56%. Parts made consisted of:

a) A single layer of the oriented pitch-based carbon mat of Example I-D on each surface, with eight layers of isotropic 0.5 inch (1.3 cm) glass (25 wt %)/PET(75 wt %) in the center.

b) A single layer of the oriented pitch-based carbon mat of Example I-D on each surface, with eight layers of the oriented 1.25 inch (3.18 cm) glass/PET mat of Example I-B in the center.

V. In a different series of tests, the oriented carbon/glass hybrid of example IV-B was repeated with an additional layer of oriented carbon mat on one surface, and made into a 4 inch (10 cm) wide "flat" beam. The resultant structure had a natural radius of curvature in the direction of orientation (machine direction) of approximately 18 inches (46 cm), with the double carbon layer surface toward the outside of the curve.

USES OF THE PRESENT INVENTION

As such, the present invention allows highly machine direction oriented large area fibrous mats to be produced at commercial speeds from the complete spectrum of natural and manmade fiber lengths, materials (including ceramics and metals), and compositions (mixtures of fiber materials and lengths), with or without thermoplastic components or other binders, on either of two major classifications of wetlay machinery. Where headbox geometry is not suitable, the present invention utilizes principles which allow simple flow pattern modifications to attain high machine direction orientation, and temporary setup on many existing commercial machines. As such, the present invention readily lends itself to the retrofitting of existing machinery. Specific elimination of foam in wet end processing minimizes floating fibers which tend to coalesce, tangle, and/or rope and diminish sheet quality and orientation. The mats are useful in high speed and/or automated production of reproducible structural parts and shapes. They can provide stiffness, reduced weight, strength, and engineered properties (physical, mass transfer, heat transfer, and electrical). In many applications, the weight savings translate to significant energy savings.

When thermally or adhesively bonded, these mats yield high modulus, light weight, structural composites suitable for, but not limited to: automotive frames, other lightweight transportation (trucks, buses, trains, airplanes), infrastructure (commercial and home construction, column reinforcement, acoustical materials), electronics (EMI, RFI shielding, cases, circuit boards, high strength insulators or conductors, heat sinks), membrane or filter reinforcements, heat sinks, consumer products including sporting goods, furniture frames, shoe parts, loudspeaker "horns", and many other applications requiring stiffness, and light weight. Laminated stacks may be of uniform composition, or of dissimilar layers combined to produce engineered properties. Single or relatively few layers of mat may be used to stiffen and reinforce automotive headliners, thermal and acoustical insulation, etc. Both porous and fully consolidated structures may be produced. Materials such as films, foils, continuous fiber filaments or strands, or textile fabrics produced by woven, nonwoven, weft insertion, or knitting means, may be inserted into the engineered stack, or onto it as decorative surfaces. Discrete patches of various shapes may be placed into or onto the stack automatically or by hand to provide desired localized properties. Oriented mats may be combined with mats of random, or other orientation. Products with controlled curvature may be produced by asymmetrically (from center of pile out), stacking layers of higher orientation, or higher stiffness (modulus). The porosity f the mat makes it suitable for stacking and efficient heating in a through—air convection oven. The mat is also suitable for compression molding or hot stamping, continuous forming in a belt press, continuous shape forming by hot roller processing, continuous shape forming by reciprocal stamping (as disclosed in the aforementioned U.S. Pat. No. 5,182,060), forming of shapes or rods by pultrusion, manufacturing structural shapes, and continuous manufacture of structural rods, ropes, and cables.

Although the aforementioned embodiments have been shown and described in detail, it is to be understood that the scope of the invention is to be defined by the following claims.

What is claimed is:

1. A method of producing highly-oriented fibrous mats having at least a 90% machine direction orientation using a wetlay machine having an open headbox and a moving wirebelt, said method comprising the steps of:

a) producing a thickened solution containing a plurality of suspended fibers, said thickened solution having a viscosity of equal to or greater than about 1.5 centipoise, said suspended fibers having fiber lengths of greater than about 0.6 cm and a modulus of at least 8 million psi;

b) introducing the thickened solution into said open headbox of the wetlay machine and reducing its velocity to less than about ⅓ the velocity of said moving wirebelt; and c) applying suction through said moving wirebelt to pin and maintain the orientation of said plurality of suspended fibers on said moving wirebelt.

2. The method of claim 1 further comprising the step of adding an anti-foaming agent to said thickened solution.

3. The method of claim 1 further comprising the step of avoiding foaming agents within said thickened solution.

4. The method of claim 1 wherein said thickened solution is produced to have a constant viscosity under normal shear.

5. The method of claim 1 wherein said thickened solution is produced to have thixotropic properties.

6. The method of claim 1 wherein said thickened solution is thixotropic and produced to have a viscosity of at least 7 centipoise.

7. The method of claim 1 wherein said thickened solution further contains a plurality of thermoplastic components.

8. The method of claim 1 wherein said suspended fibers have fiber lengths in the range of about 0.6 cm to 6.35 cm.

9. The method of claim 1 wherein said suspended fibers have fiber lengths in the range of about 1.9 cm to 3.2 cm.

10. The method of claim 7 wherein said reinforcement fibers have a modulus of least 8 million psi (55.2 gigapascals).

11. The method of claim 7 wherein said suspended fibers have surface treatments designed to promote adhesion to said thermoplastic components.

12. The method of claim 1 wherein said suspended fibers are all made of one material and have at least substantially the same length and diameter.

13. The method of claim 1 wherein said suspended fibers are made of a mixture of materials, and have different lengths, diameters and compositions.

14. The method of claim 7 wherein concentration of said suspended fibers to said thermoplastic components is in the range of 60–70% by weight of said suspended fibers to 40–30% by weight of said thermoplastic components.

15. The method of claim 7 wherein said thermoplastic component is selected from the group consisting of fibers, granular particles and flat platelets.

16. The method of claim 7 wherein said thermoplastic components are fibers with lengths in the range of ¼" to ¾" (0.6 to 1.9 cm).

17. The method of claim 7 wherein said thermoplastic component is fibers selected from the group consisting of drawn and undrawn fibers.

18. The method of claim wherein said thermoplastic components are made of the same material and are all substantially the same size.

19. The method of claim 7 wherein said thermoplastic components are made of a mixture of materials, and have different sizes and melting points.

20. The method of claim 7 further comprising the step of adding at least one additional material to the thermoplastic component selected from the group consisting of fillers, antioxidants, coloring agents, electrically-conductive materials, electrically-insulating materials, thermally-conductive materials, thermally-insulating materials, adhesion aids, melt flow modifiers, cross-linking agents, chemically-reactive materials, biologically-reactive materials and molecular sieves.

21. The method of claim 1 further comprising the step of maintaining said open headbox.

22. The method of claim 1 wherein said thickened solution is introduced into said open headbox uniformly across a width of said open headbox and substantially vertically upward against a liquid head to slow and turn the plurality of suspended fibers toward the moving wirebelt with reduced turbulence and with reduced linear velocity.

23. The method of claim 1 wherein said thickened solution is introduced into said open headbox in a substantially backward and upward direction from the direction of the moving wirebelt, and is slowed against a liquid head to reverse flow of said plurality of suspended fibers in a smooth pattern and to present said plurality of suspended fibers to the moving wirebelt with reduced velocity and turbulence.

* * * * *